United States Patent [19]

Prusak

[11] 4,309,265

[45] Jan. 5, 1982

[54] CATHODE MASK KNOB

[75] Inventor: John J. Prusak, Indianapolis, Ind.

[73] Assignee: RCA Corporation, New York, N.Y.

[21] Appl. No.: 225,443

[22] Filed: Jan. 15, 1981

[51] Int. Cl.[3] ..... C25D 17/00; C25D 17/06

[52] U.S. Cl. ..... 204/279; 204/281

[58] Field of Search ..... 204/5, 194, 279, 281

[56] References Cited

U.S. PATENT DOCUMENTS 2,751,345 6/1956 Osman ..... 204/5
2,890,160 6/1959 Hunting ..... 204/281
2,905,614 9/1959 Porrata ..... 204/281
4,176,039 11/1979 Wismer ..... 204/279

*Primary Examiner*—T. M. Tufariello
*Attorney, Agent, or Firm*—Birgit E. Morris; Edward J. Sites

[57] ABSTRACT

A cathode mask knob is disclosed which has a metal insert for holding a matrix in mechanical and electrical contact with the end of the cathode of an electroforming apparatus. The knob further has a resiliant seal around the insert and an outer shield of a dielectric material.

7 Claims, 4 Drawing Figures

CATHODE MASK KNOB

This invention relates to a device for attaching parts which are to be duplicated by electroforming to the cathode of an electroforming apparatus. More particularly, this invention is concerned with a knob for securing the center portion of a record matrix which is to be replicated to a cathode mask of an electroforming apparatus, so as to provide improved electrical and mechanical contact of the matrix to the cathode.

BACKGROUND OF THE INVENTION

In the manufacture of records such as audio records or the newer type of video disc, the initial step in the manufacturing process is to cut a recording of the information desired to be molded into the record into a recording substrate. Recordings for audio records are generally cut into a wax or lacquer substrate. Other types of records which have smaller signal elements, such as video discs, are generally cut into metal substrates.

The recorded substrate is then replicated in a matrixing process. The surface of a wax or lacquer recording substrate is activated and then a thin layer of a conductive material is applied to the surface of the substrate as, for example, by electroless plating. Thereafter, a metal, typically nickel, is electrodeposited on the recorded substrate until a predetermined thickness of metal is deposited. The electroformed part thus prepared is separated from the wax or lacquer substrate and is used as a master in the subsequent matrixing steps.

The procedure which is used for making replicas from metal recording substrate is slightly different. The surface of the metal recording substrate is passivated to prevent the adhesion of electroplated metal to the metal substrate. Thereafter, a metal, such as nickel, is electrodeposited on the surface of the metal recording substrate. When a sufficient thickness of metal has built up on the substrate the resulting electroformed part is separated from the metal recording substrate and is thereafter used as the master in subsequent matrixing steps.

Once the masters are obtained, the matrixing processes employed for further replication are generally similar for various types of records. The masters are mounted on revolvable cathode masks in an electroforming apparatus. The cathode mask with the master secured to it is immersed into the electrolyte solution and revolved in the solution while a metal is electroformed onto the master. The metal is electroplated onto the masters until sufficient thickness of metal is deposited so as to provide an electroformed part referred to as a mold. The molds are in turn replicated in an additional electroforming step to form a new series of parts referred to as stampers. The stampers are subsequently used in the pressing of records.

A number of problems have been encountered in the matrixing processes. When the masters are mounted on the revolving cathode mask to form a mold, or when the molds are mounted on the revolving cathode mask to form a stamper, it is extremely important that the part which is to be replicated, hereinafter referred to as the matrix, be properly positioned and sealed in a liquid tight fit to the cathode mask. The matrix must be mounted flush onto the cathode mask. The outer edge and the center hole of the matrix must be sealed liquid tight to the cathode mask to prevent electrolyte from flowing behind the matrix.

The problems presented when sealing the center hole are much more difficult to overcome than those presented when sealing the outer edge of the matrix to the cathode mask. The electrical contact of the cathode to the matrix is made at the center portion of the matrix. The center portion of the matrix should be in full flush contact with the exposed metal surface of the cathode. If full contact is not established and maintained at the center portion, high electrical resistance develops which causes burn outs and treeing about the center hole. The problems encountered in making good electrical contact between the cathode and the matrix are made more difficult because of the relatively small area available for making the electrical connection at the center portion of the matrix.

A further problem encountered at the center hole is that if a liquid tight seal is not made about the center hole, electrolyte which is used in the plating bath will flow through the center hole to the reverse side of the matrix causing plating on the back of the matrix and eventually distortion of the matrix or electrolytic errosion of the matrix.

Various suggestions have been made in prior art to improve the electrical contact and prevent leakage at the center hole. Suggestions were made, for example, to solder brass strips to the matrix being duplicated to improve the electrical contact of the matrix with the cathode. This technique was unsatisfactory as it was both costly and did not provide consistent satisfactory results. Suggestions were also made to use rubber plugs, and the like, to seal the center hole. This suggestion did not prove to be effective in preventing leakage of the electrolyte of the back of the matrix in part because of the irregularity in the size of the center hole. It was also suggested to use metal screws, and the like, at the center hole to secure the matrix to the cathode mask. However, in practice the screws, and other mechanical fasteners, allow electrolyte leakage and were plated over during electroforming causing considerable problems in separating the electroformed part from the matrix. A further suggestion was made by Hunting et al. in U.S. Pat. No. 2,890,160, issued June 9, 1959; entitled, FIXTURE SUSPENDING PHONOGRAPH RECORD BLANK. Hunting et al. suggested the use of a rubber cathode mask having a metal backup plate at the rear thereof, and using a metal screw to form a compression seal of the matrix to the face of the rubber cathode mask at the center hole. This suggestion, like the others heretofore made did not prove to be satisfactory in practice because of the relatively poor seal made at the center hole, and also because of problems caused by plating over the metal screw used to attach the matrix to the rubber cathode mask.

What would be highly advantageous would be a device for attaching the matrix to the cathode which would make a secure electrical contact of the matrix to the cathode; and which would further include the means to prevent the flow of electrolyte from the electrolytic bath through the center hole of the matrix.

SUMMARY OF THE INVENTION

A cathode mask knob is disclosed which has a metal insert for holding a matrix in electrical contact with an end of the cathode of an electroforming apparatus. The knob further has a resilient seal around the insert for sealing the center hole of the matrix and an outer shield of a dielectric material for preventing plating of the metal insert.

DETAILED DESCRIPTION OF THE INVENTION

Figure 1:
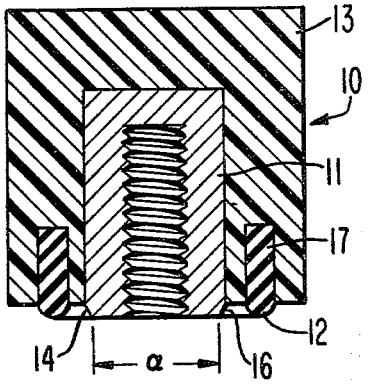
FIG. 1 is a cross-sectional illustration of a first embodiment of this invention.

The cathode mask 10 is comprised of a metal insert 11, resilient seal 12 which surrounds the metal insert 11, and an outer shield 13 which is made of a dielectric material.

The metal insert 11 is preferably made of the same metal as that of the cathode of the electroforming apparatus with which the cathode knob 10 will be employed with the preferred metal being copper.

The metal insert 11 has a diameter (d) at its exposed end 14 which preferably is about the same size as the diameter as the cathode with which it will be used.

The insert 11, as illustrated, has a threaded hole 15 in the center. The threaded hole 15 is of a size which will mate with a corresponding stud extending from the cathode of the electroplating apparatus. It should be noted, however, that if the cathode was drilled and tapped, rather than having a stud, as illustrated, that the metal insert 11 of the cathode mask knob 10 would be made with a stud rather than a threaded hole 15.

The metal insert 11 is enclosed by an outer shield 13, except at the exposed end 14 where a boss 16 of the insert 11 is exposed. The outer shield 13 is made of a dielectric material, such as a polyester or epoxy plastic.

A circular groove 17 is cut into the shield 13 slightly spaced apart and completely around the metal insert 11. A resilient seal 12 is inserted into the groove 17 and extends slightly below the end of the shield.

Figure 2:
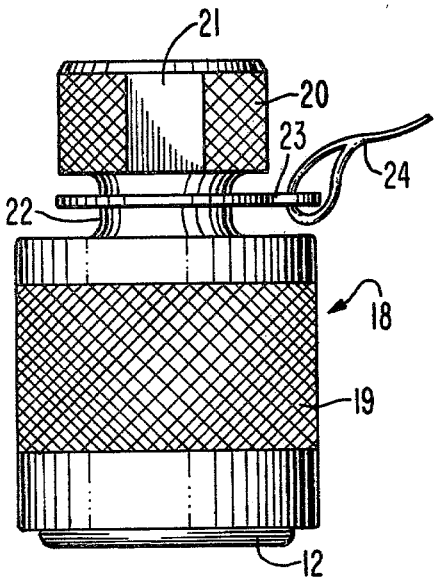
FIG. 2 is a illustration of a second embodiment of this invention.
Figure 3:
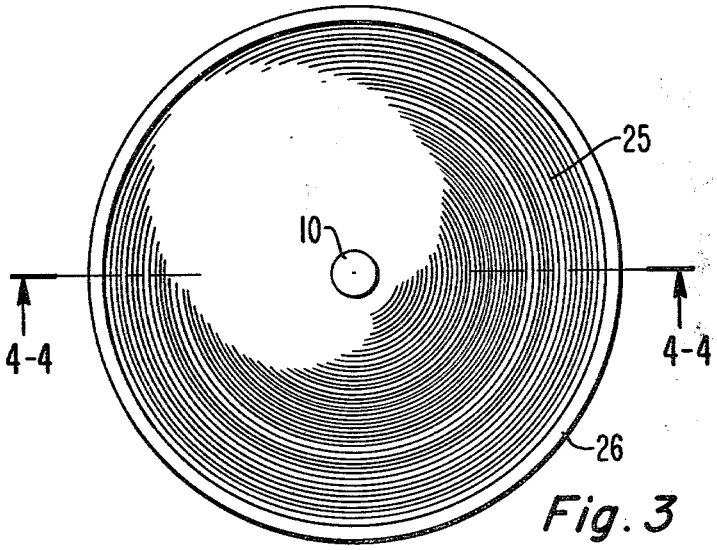
FIG. 3 is a top plane view of a matrix mounted in a cathode mask with the cathode knob of this invention in place.
Figure 4:
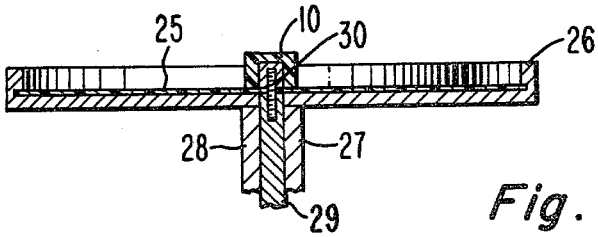
FIG. 4 is a cross-section taken as indicated by the lines and arrows 4—4 on FIG. 1.

In FIG. 2, an alternate embodiment of the cathode mask knob 18 of this invention is illustrated. The construction of the main portion of this embodiment 18 is similar to that of the knob illustrated in cross section in FIG. 1. There are, however, certain additional features incorporated in the alternate embodiment 18 which have been found to be of considerable value when using the cathode mask knob 18. The outer surface 19 of the cathode mask knob 8 is knurled to permit better gripping of the knob 18 by operators. An extension 20 is provided at the end opposite the exposed end of the metal insert 11. The extension 20 has a hexagonal section 21 so that the knob 18 can be tightened or loosened with a wrench. The extension 20 further has a section of reduced diameter 22 onto which there is secured a freely rotatable retaining ring 23. A cord 24 of a material which is not attacked by the electrolyte solution is secured at one of its ends to the retaining ring 23. The opposite end of the cord 24 in use is secured to a stationary portion of the electroforming apparatus so that, if the knob 18 is accidently dropped into the electroplating bath, it can be safely retrieved from the electroplating bath by simply drawing the cord and the attached knob out of the bath.

The cathode mask knob 10, 18 of this invention, can be used with conventional electroforming apparatus employed for the manufacture of masters, molds and stampers in the record industry. A matrix 25 that is to be reproduced is mounted in a cathode mask 26. The cathode mask 26 is made of a dielectric material, such as plastic. The outer edge of the matrix 25 is sealed liquid tight to the cathode mask 26. The cathode mask 26 is secured to a rotatable cathode support 27 which has an outer shell 28 of a dielectric material which encases and insulates the cathode 29.

The cathode 29 preferably extends through the cathode mask 26 and includes a stud 30, which extends outwardly from the surface of the cathode mask 26. The cathode mask knob 10, 18 is threaded onto the stud 30 and tightened. The boss 16 on the metal insert 11 of the cathode mask knob 10, 18, makes mechanical and electrical contact with the surface of the matrix 25, and as it is tightened forces the matrix 25 into contact with the end of the cathode 29.

When the cathode mask knob 10, 18 is tightened together, the resilient seal 12 is slightly compressed and forms a liquid-tight seal around the metal insert 12, sealing the center hole in the matrix 25 so that the electrolyte from the electroplating bath cannot leak through the hole to the back of the matrix.

When plating is commenced, the cathode mask 26 with the matrix 25 secured to its surface is immersed in the electrolyte of the electroforming apparatus. There is a low resistance to the flow of current at the center portion of the matrix because of the full contact made on both the backside and the frontside of the matrix by the cathode and the cathode mask knob 10, 18. During electroforming, the metal being plated, such as nickel, selectively deposits on the surface of the matrix. The metal will not plate onto the outer surface of the shield 13, and only extends to the outer edge of the seal 12. When the plating is completed, it is relatively simple to remove the knob from the electroformed part, and the matrix and electroformed part can be easily separated at the center hole. It has been found, using the knob of this invention 10, that burnout or treeing does not occur adjacent to the center hole and the center of the matrix is sealed liquid tight to the electrolyte.

We claim:

1. The device for holding the center portion of a record matrix in liquid-tight electrical contact with a threaded end of a cathode of an electroforming apparatus; said device being an integral member comprised of a metal insert, a dielectric shield and a resilient seal; said metal insert having an exposed threaded end portion shaped to threadably engage and mate with the threaded end of the cathode; said metal insert being mounted in said dielectric shield with said shield electrically insulating all the surfaces of the metal insert with the exception of the exposed end portion and said resilient seal being positioned in said shield adjacent to and surrounding the metal insert whereby when a matrix is placed on the surface of said cathode and said device is threaded with and tightened onto said cathode, the metal insert forces the matrix into electrical contact with the cathode; the seal member compresses to form a liquid-tight seal about the metal insert and the dielectric shield prevents plating of the metal insert.

2. The device according to claim 1 wherein the metal insert has a female threaded end portion.

3. The device according to claim 1 wherein the metal insert is made of the same metal as the cathode.

4. The device according to claim 1 wherein the outer surface of the dielectric shield is knurled.

5. The device according to claim 1 wherein the outer surface of the dielectric shield is shaped to be mechanically engaged with a wrench.

6. The device according to claim 5 wherein a portion of the outer surface of the shield is hexagonal in cross section.

7. The device according to claim 1 includes a cord means for securing said device to the electroforming apparatus.

* * * * *